US008100642B2

(12) United States Patent
Hwang et al.

(10) Patent No.: US 8,100,642 B2
(45) Date of Patent: Jan. 24, 2012

(54) CENTRIFUGAL BLOWER

(75) Inventors: Ching-Bai Hwang, Taipei Hsien (TW); Zhi-Hui Zhao, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 673 days.

(21) Appl. No.: 12/248,014

(22) Filed: Oct. 8, 2008

(65) Prior Publication Data

US 2010/0068047 A1 Mar. 18, 2010

(30) Foreign Application Priority Data

Sep. 12, 2008 (CN) ..... 2008 1 0304493

(51) Int. Cl.
*F04D 29/44* (2006.01)
*F04D 29/54* (2006.01)

(52) U.S. Cl. ..... 415/206; 415/203

(58) Field of Classification Search ..... 415/206, 415/203, 224, 212.1, 97, 204
See application file for complete search history.

(56) References Cited

U.S. PATENT DOCUMENTS

| | | | | |
|---|---|---|---|---|
| 5,997,246 | A * | 12/1999 | Humbad | 415/119 |
| 2005/0249587 | A1* | 11/2005 | Paulsen | 415/146 |
| 2005/0260073 | A1* | 11/2005 | Hsu et al. | 415/199.6 |
| 2006/0275115 | A1* | 12/2006 | Wu et al. | 415/206 |
| 2008/0011461 | A1 | 1/2008 | Hwang et al. | |
| 2008/0219838 | A1* | 9/2008 | Kusano | 415/203 |
| 2008/0267764 | A1* | 10/2008 | Tsai et al. | 415/53.3 |
| 2009/0324403 | A1* | 12/2009 | Zheng | 415/203 |

FOREIGN PATENT DOCUMENTS

CN 101083889 A 12/2007

* cited by examiner

*Primary Examiner* — Caridad Everhart
(74) *Attorney, Agent, or Firm* — Altis Law Group, Inc.

(57) ABSTRACT

A centrifugal blower includes a housing (10), a cover (30) arranged on the housing, and an impeller (20) received in a space (25) formed between the housing and the cover. The housing includes a bottom wall (11) and a sidewall (12) surrounding the bottom wall. The sidewall defines an air outlet (121) therein. The sidewall and the impeller cooperatively define an air channel (24) therebetween. The cover includes a main body (31) and a tongue (32) extending from the main body. The tongue is a V-shaped flake and adjacent to the air outlet. The tongue extends into the air channel and protrudes toward the impeller.

13 Claims, 5 Drawing Sheets

CENTRIFUGAL BLOWER

BACKGROUND

1. Technical Field

The present invention relates to centrifugal blowers, and particularly to a centrifugal blower for dissipating heat generated by electronic components.

2. Description of Related Art

It is well known that heat is generated by electronic components such as integrated circuit chips during operation thereof. If the heat is not efficiently removed, these electronic components may suffer damage. Thus, centrifugal blowers are often used to cool the electronic components.

A typical centrifugal blower includes a housing, a cover on the housing, and a stator and an impeller received in a space formed between the housing and the cover. The housing includes a bottom wall and a sidewall extending upwardly from the bottom wall. The bottom wall and the cover each define an air inlet therein. The sidewall defines an air outlet therein, and has a tongue adjacent to the air outlet. The tongue extends from the sidewall into the space between the housing and the cover, and protrudes toward the impeller, so as to increase a pressure of an airflow generated by the impeller.

However, the tongue of the centrifugal blower has a relatively greater thickness, which requires more raw materials to construct it. In addition, since a distance of the tongue protruding to the impeller is different at different positions, the thickness of the tongue is not even. Thus, the tongue is easily desiccated, shrunk to deform during the molding fabrication process, which reduces a quality of the production.

What is needed, therefore, is a centrifugal blower which can overcome the above-mentioned disadvantage.

SUMMARY

A centrifugal blower according to an embodiment of the present invention includes a housing, a cover arranged on the housing, and an impeller received in a space formed between the housing and the cover. The housing includes a bottom wall and a sidewall surrounding the bottom wall. The sidewall defines an air outlet therein. The sidewall and the impeller cooperatively define an air channel therebetween. The cover includes a main body and a tongue extending from the main body toward the bottom wall of the housing. The tongue is flake-shaped with an even thickness and adjacent to the air outlet. The tongue extends into the air channel and protrudes toward the impeller.

Other advantages and novel features of the present impeller and centrifugal blower will become more apparent from the following detailed description of preferred embodiments when taken in conjunction with the accompanying drawings.

BRIEF DESCRIPTION OF THE DRAWINGS

Many aspects of the present centrifugal blower can be better understood with reference to the following drawings. The components in the drawings are not necessarily drawn to scale, the emphasis instead being placed upon clearly illustrating the principles of the disclosed centrifugal blower. Moreover, in the drawings, like reference numerals designate corresponding parts throughout the several views.

DETAILED DESCRIPTION

Figure 1:
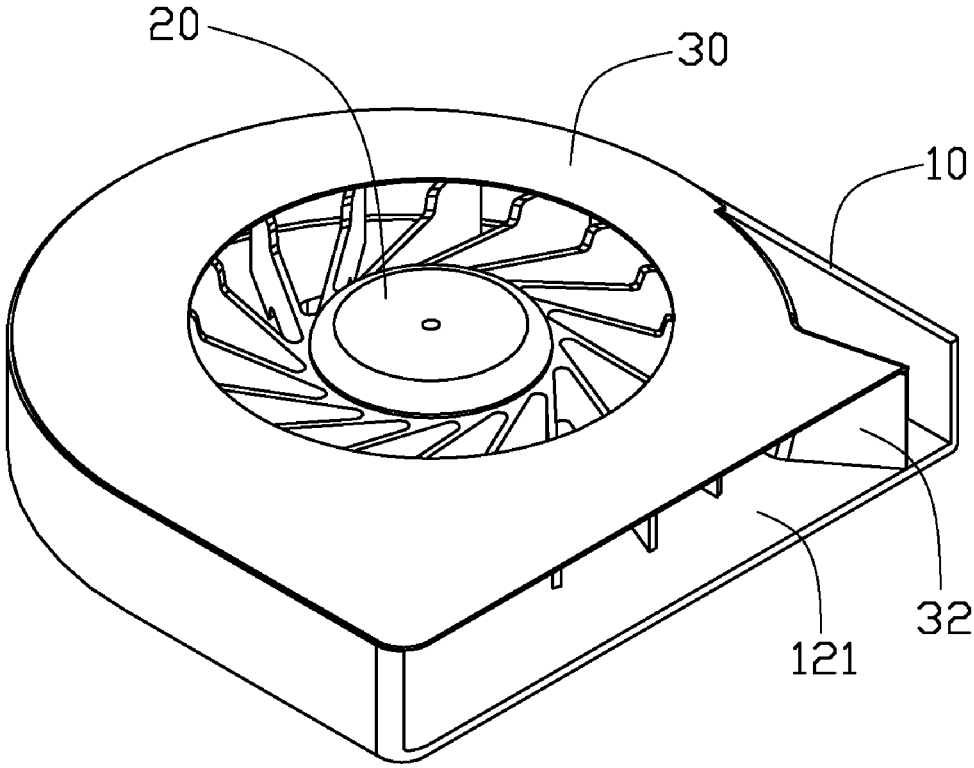
FIG. 1 is an assembled, isometric view of a centrifugal blower in accordance with a first embodiment of the present invention.

Reference will now be made to the drawing figures to describe the embodiments in detail.

Figure 2:
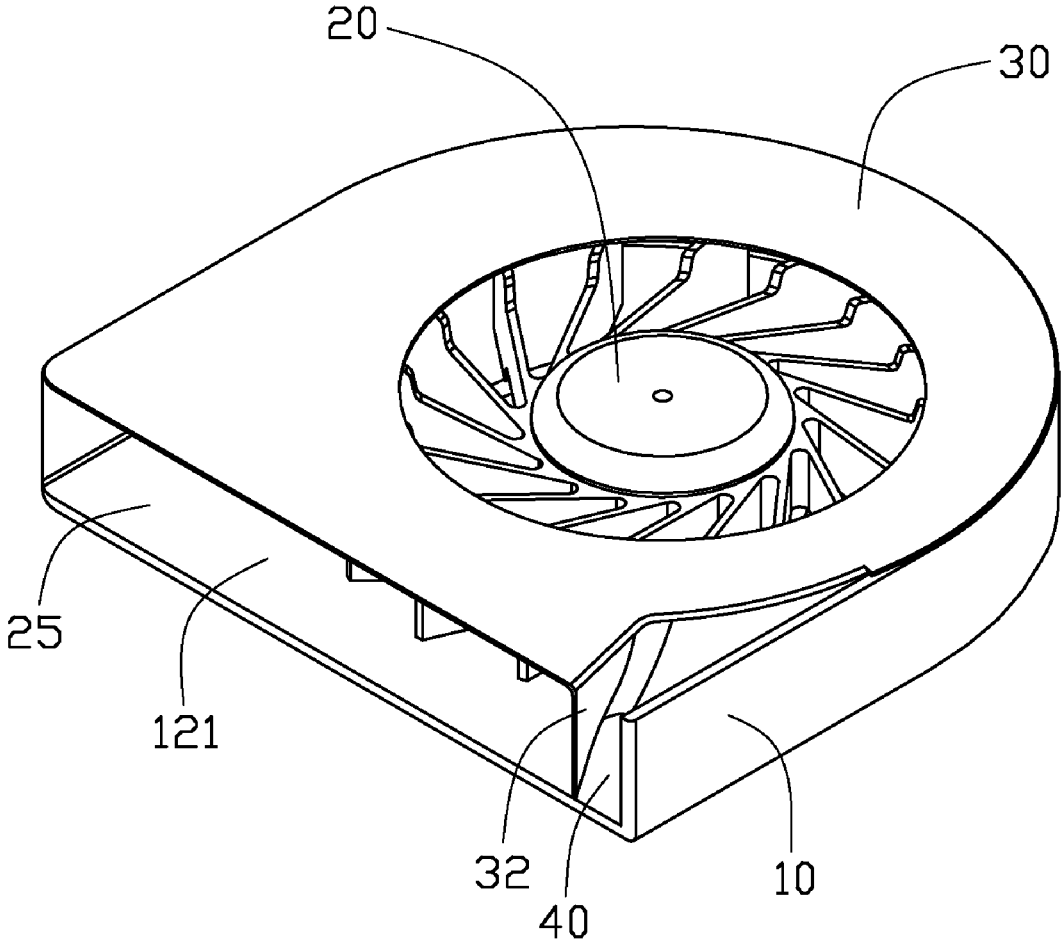
FIG. 2 is similar to FIG. 1, but viewed from another aspect.

Referring to FIGS. 1 and 2, a centrifugal blower in accordance with a first embodiment of the present invention is shown. The centrifugal blower includes a housing 10, a cover 30 arranged on the housing 10, and a stator and an impeller 20 received in a space 25 formed between the housing 10 and the cover 30.

Figure 3:
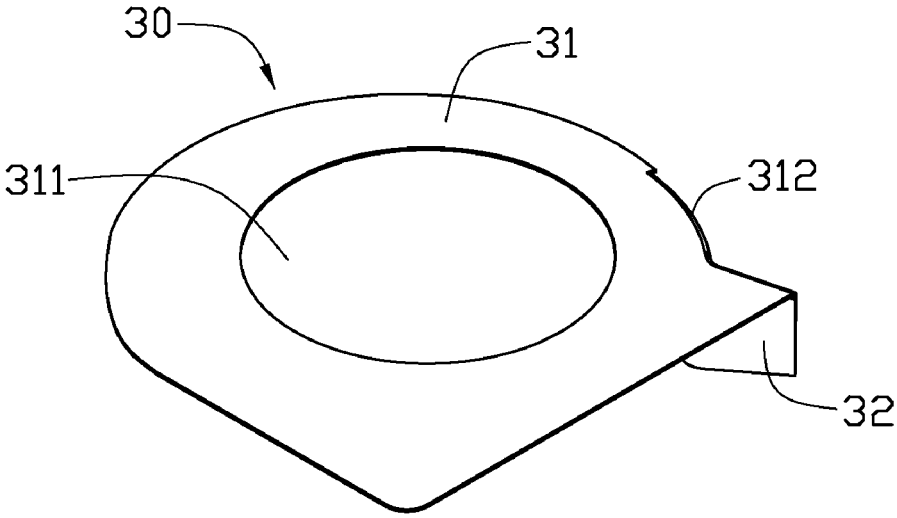
FIG. 3 is an exploded, isometric view of the centrifugal blower of FIG. 1.
Figure 3:
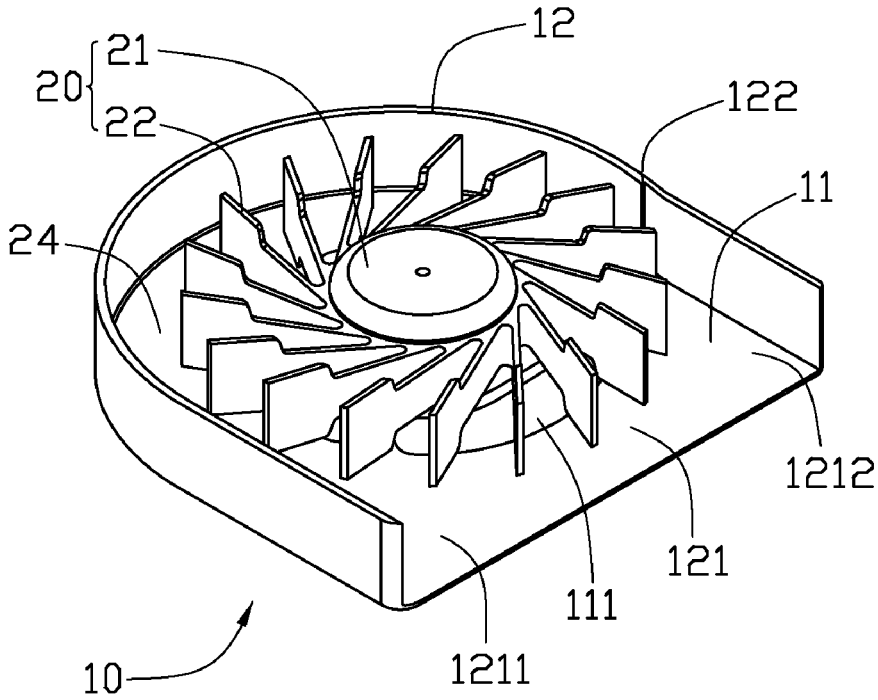

Referring to FIG. 3, the housing 10 includes a bottom wall 11 and a sidewall 12 extending upwardly from and surrounding the bottom wall 11. The bottom wall 11 defines an air inlet 111 therein. The sidewall 12 defines an air outlet 121 which is perpendicular to the air inlet 111. The air outlet 121 includes a near side 1211 and a rear side 1212 at opposite sides thereof. The impeller 20 includes a hub 21 and a plurality of blades 22 radially and outwardly extending from the hub 21. An air channel 24 is defined between free ends of the blades 22 and an inner surface of the sidewall 12 of the housing 10. During operation of the centrifugal blower, the impeller 20 drives airflow into the space 25. The airflow then flows through the channel 24 from the rear side 1212 toward the near side 1211, and finally flows out the blower through the air outlet 121. The sidewall 12 has a step 122 adjacent to the rear side 1212. The step 122 is perpendicular to the bottom wall 11.

Figure 4:
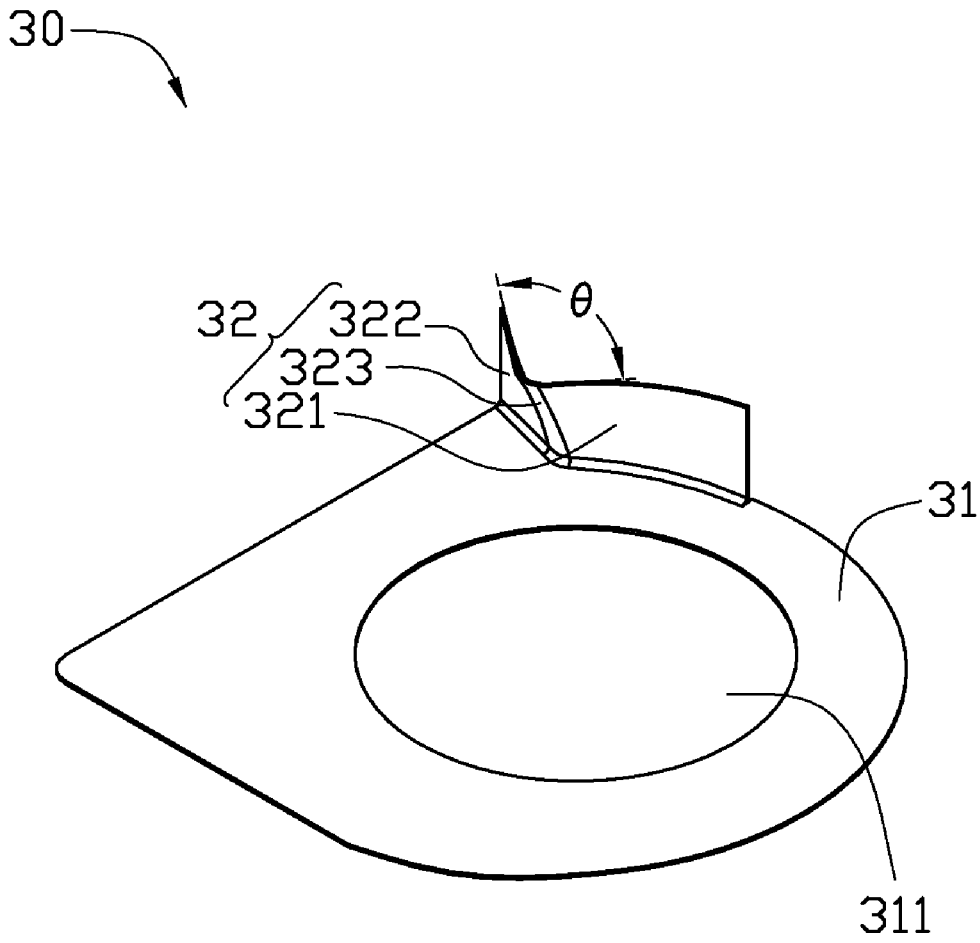
FIG. 4 is an isometric view of a cover of the centrifugal blower of FIG. 3, but viewed from another aspect.

The cover 30 includes a main body 31 and a tongue 32 extending downwardly from the main body 31. The main body 31 is flake-shaped, and has a similar configuration as the bottom wall 11. The main body 31 defines an air inlet 311 at a middle thereof and a cutout 312 adjacent to the rear side 1212 of the air outlet 121. The air inlet 311 aligns with the air inlet 111 of the bottom wall 11. The cutout 312 is substantially V-shaped. The tongue 32 extends integrally from an outer periphery of the main body 31 which is adjacent to cutout 312. Particularly referring to FIG. 4, the tongue 32 is flake-shaped, and has a vertical height equal to that of the sidewall 12. The tongue 32 includes a first flake 321 located inside the air outlet 121, a second flake 322 located near the air outlet 121, and a third flake 323 which smoothly and integrally connects the first flake 321 with the second flake 322. The first flake 321 has an arc-shaped surface which extends along an extension direction of the air channel 24. The second flake 322 has a substantially planar surface, and the third flake 322 has an arc-shaped surface. The first, second and third flakes 321, 322, 323 cooperatively form a V-shaped structure of the tongue 32. Alternatively, the surface of the second flake 322 can be arc-shaped. The first and third flakes 321, 323 are arced toward opposite directions.

A thickness of the third flake 322 is equal to a width of the step 122 along a direction protruding toward the impeller 20, whereby the third flake 322 connects smoothly with the sidewall 12. An angle θ is defined between outer surfaces of the first and second flakes 321, 322, and the angle θ is larger than 90 degree. The first, second and third flakes 321, 322, 323 respectively and gradually inclines toward the free ends of the blades 22 from a bottommost end of the tongue 32 toward a topmost end of the tongue 32. That is, the tongue 32 is slantingly arranged in respect with the free ends of the blades 22.

Referring back to FIG. 2, when the cover 30 is arranged on a top of the sidewall 12 of the housing 10, the tongue 32 of the cover 30 extends into the air channel 24 between the blades 22 and the sidewall 12, with the bottommost end of the tongue 32 abutting against the bottom wall 11. A lateral side of the third flake 322 of the tongue 32 abuts against the step 122, and an inner surface of the third flake 322 connects smoothly with the inner surface the sidewall 12. Thus, the inner surface of the third flake 322 and the inner surface of the sidewall 12 cooperatively form a curved surface guiding flowing of the airflow. The tongue 32 protrudes toward the free ends of the blades 22, whereby the air channel 24 forms a volute structure. Specifically, a width of the air channel 24 in a radial direction of the impeller 20 gradually increases along a counterclockwise direction from the rear side 1212 toward the near side 1211 of the air outlet 121. A distance between the first, second and third flakes 321, 322, 323 of the tongue 32 and the free ends of the blades 22 respectively and gradually increases along a direction from the bottom wall 11 toward the main body 31. An outer surface of the tongue 32 and the sidewall 12 cooperatively define a gap 40 (shown in FIG. 2) therebetween.

In the present centrifugal blower, the flake-shaped tongue 32 can save raw material for constructing it when compared with typical centrifugal blowers, since the tongue 32 has a small thickness which is achieved due to the formation of the cutout 312. In addition, since the flake-shaped tongue 32 has a substantially even thickness, the tongue 32 is not easily desiccated, shrunk to deform during the molding fabrication process. Thus, a quality of the production is reduced. Furthermore, the tongue 32 extends downwardly from the main body 31. When the tongue 32 is unexpectedly deformed or needs to be redesigned to satisfy different requirements, only the cover 30 needs to be disassembled and replaced. Thus, there is no need to disassemble the stator and the impeller 20 from the housing 10, which reduces a manufacturing cost of the centrifugal blower. Moreover, the distance from the first, second and third flakes 321, 322, 323 of the tongue 32 to the free ends of the blades 22 is respectively variable along the direction from the bottom wall 11 toward the main body 31. The slantwise tongue 32 disturbs the superposition of the harmonic waves and thereby decreases noise generated by the centrifugal blower.

Figure 5:
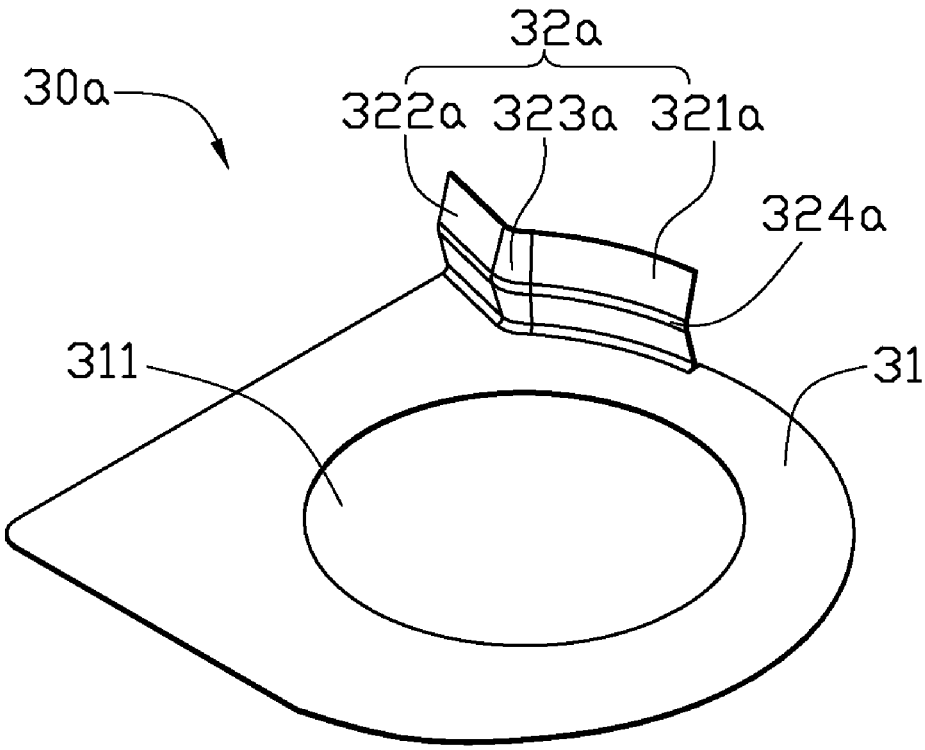
FIG. 5 is an isometric view of a cover of the centrifugal blower in accordance with a second embodiment of the present invention.

Referring to FIG. 5, a cover 30*a* of a centrifugal blower in accordance with a second embodiment of the present invention is shown. The cover 30*a* is similar to the cover 30 in the first embodiment. In the present embodiment, the tongue 32*a* has a middle portion 324*a* substantially parallel to the main body 31 of the cover 30*a*. The tongue 32*a* extends inwardly toward the blades 22 from the bottommost end to the middle portion 324*a*, and outwardly away from the blades 22 from the middle portion 324*a* toward the topmost end. The distance from each of the first, second and third flakes 321*a*, 322*a*, 323*a* of the tongue 32*a* to the free ends of the blades 22 gradually increases along directions respectively from the middle portion 324*a* toward the bottom wall 11 and toward the main body 31.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A centrifugal blower comprising:

a housing comprising a bottom wall and a sidewall surrounding the bottom wall, the sidewall defining an air outlet therein;

a cover arranged on a top of the sidewall of the housing, the cover comprising a main body and a tongue extending from the main body toward the bottom wall, the tongue being flake-shaped with an even thickness and located adjacent to the air outlet, the tongue comprising a first flake, a second flake and a third flake smoothly connecting with the first and second flakes; and an impeller received in a space formed between the housing and the cover, the impeller and the sidewall cooperatively defining an air channel therebetween, the impeller comprising a hub and a plurality of blades extending outwardly from the hub, the tongue extending into the air channel and protruding toward the impeller, a distance from at least one of the first, second and third flakes to the free ends of the blades being variable along the direction from the bottom wall toward the main body.

2. The centrifugal blower of claim 1, wherein a distance from each of the first, second and third flakes of the tongue to the free ends of the blades gradually increases along the direction from the bottom wall toward the main body.

3. The centrifugal blower of claim 1, wherein a distance from each of the first, second and third flakes of the tongue to the free ends of the blades gradually increases along directions respectively from a middle portion of the tongue toward the bottom wall and toward the main body.

4. The centrifugal blower of claim 1, wherein the first, second and third flakes cooperatively form a V-shaped structure of the tongue.

5. The centrifugal blower of claim 1, wherein the sidewall comprises a step adjacent to the air outlet, the tongue having a width equal to that of the step, the tongue abutting against the step, an inner surface of the tongue smoothly connecting with an inner surface of the sidewall.

6. The centrifugal blower of claim 1, wherein an outer surface of the tongue and the sidewall cooperatively define a gap therebetween.

7. A centrifugal blower comprising:

a bottom wall;

a cover parallel to the bottom wall;

a sidewall interconnecting outer peripheries of the bottom wall and the cover, the sidewall defining an air outlet therein, the air outlet comprising a near side and a rear side at opposite sides thereof;

an impeller received in a space formed among the bottom wall, the sidewall and the cover, the impeller comprising a hub and a plurality of blades outwardly extending from the hub; and a tongue received in the space and arranged between the cover and the bottom wall, the tongue being flake-shaped with an even thickness and located adjacent to the rear side of the air outlet, the tongue comprising a first flake, a second flake and a third flake smoothly connecting with the first and second flakes, a distance from at least one of the first, second and third flakes to the free ends of the blades being variable along the direction from the bottom wall toward the cover, a volute air channel being defined among the tongue, the sidewall and the impeller, the impeller being used to drive airflow to flow from the rear side toward the near side of the air outlet along the air channel.

8. The centrifugal blower of claim 7, wherein the distance from the tongue to the free ends of the blades gradually increases along the direction from the bottom wall toward the cover.

9. The centrifugal blower of claim 7, wherein the distance from the tongue to the free ends of the blades gradually increases along directions respectively from a middle portion of the tongue toward the bottom wall and toward the cover.

10. The centrifugal blower of claim 7, wherein the first flake, the second flake and the third flake cooperatively form a V-shaped structure of the tongue.

11. The centrifugal blower of claim 7, wherein the sidewall comprises a step adjacent to the air outlet, the tongue having a width equal to that of the step, the tongue abutting against the step, an inner surface of the tongue smoothly connecting with an inner surface of the sidewall.

12. The centrifugal blower of claim 7, wherein a V-shaped cutout is formed by the cover and adjacent to an outer surface of the tongue.

13. A centrifugal blower comprising:

a bottom wall;

a cover parallel to the bottom wall;

a sidewall interconnecting outer peripheries of the bottom wall and the cover, the sidewall defining an air outlet therein, the air outlet comprising a near side and a rear side at opposite sides thereof;

an impeller received in a space formed among the bottom wall, the sidewall and the cover;

a tongue received in the space and arranged between the cover and the bottom wall, the tongue being flake-shaped with an even thickness and located adjacent to the rear side of the air outlet, a volute air channel being defined among the tongue, the sidewall and the impeller, the impeller being used to drive airflow to flow from the rear side toward the near side of the air outlet along the air channel; and wherein the tongue comprises a first flake, a second flake and a third flake, and the first flake, the second flake and the third flake cooperatively form a V-shaped structure of the tongue.

* * * * *